US005085421A

United States Patent [19]

Sellers

[11] Patent Number: 5,085,421

[45] Date of Patent: Feb. 4, 1992

[54] DUAL BIN PAPER FEED TRAY FOR AN IMAGE REPRODUCTION MACHINE SUCH AS A PRINTER OR COPIER

[75] Inventor: Charles Sellers, Houston, Tex.

[73] Assignee: Compaq Computer Corporation, Houston, Tex.

[21] Appl. No.: 664,407

[22] Filed: Mar. 4, 1991

[51] Int. Cl.[5] ..... B65H 1/26

[52] U.S. Cl. ..... 271/155; 271/157; 271/158; 221/11; 221/106

[58] Field of Search ..... 271/157, 158, 155, 152, 271/147, 145, 9; 414/795 B; 221/11, 104, 106

[56] References Cited

U.S. PATENT DOCUMENTS

| | | | |
|---|---|---|---|
| 3,776,544 | 12/1973 | Watson et al. | 271/157 X |
| 3,887,178 | 6/1975 | Fujimoto | 271/152 X |
| 4,109,779 | 8/1978 | Bauer et al. | 400/584 |
| 4,119,219 | 10/1978 | Marschke | 414/795 B X |
| 4,397,542 | 8/1983 | Brodesser | 355/14 R |
| 4,569,587 | 2/1986 | Miyoshi et al. | 355/72 |
| 4,585,223 | 4/1986 | Tam | 271/121 |
| 4,603,846 | 8/1986 | Miles | 271/2 |
| 4,620,809 | 11/1986 | Runzi | 400/624 |
| 4,639,154 | 1/1987 | Myers | 400/584 |
| 4,671,504 | 6/1987 | Lapinski et al. | 271/126 |
| 4,729,683 | 3/1988 | Stamiszewski | 400/624 |
| 4,733,310 | 3/1988 | Kapp et al. | 358/300 |
| 4,807,805 | 2/1989 | Rutkowski | 229/69 |

FOREIGN PATENT DOCUMENTS

| | | | |
|---|---|---|---|
| 881196 | 6/1953 | Fed. Rep. of Germany | 271/157 |

*Primary Examiner*—David H. Bollinger
*Attorney, Agent, or Firm*—Johnson & Gibbs

[57] ABSTRACT

A dual bin paper feed tray is removably insertable into the standard height tray-receiving housing opening of an image reproduction machine such as a printer or copier. The tray has adjacent front and rear paper holding bin areas each configured to hold a stack of approximately 250 cut paper sheets, the overall tray thus being adapted to hold the entire contents of a standard one ream package of cut paper sheets. In operation, the loaded tray is inserted, front end first, into the housing opening and the machine's paper feed system operates to sequentially feed paper sheets from the front tray bin into the machine. When the machine's paper sensing system detects that the front bin has been emptied, a drive motor on the rear end of the tray is energized to activate a shift structure which operates to move the rear paper stack into the front tray bin for infeed to the machine. In an alternate embodiment of the tray, the rear paper stack is supported for manual movement into the front tray bin after the front paper stack has been used up by the machine.

31 Claims, 6 Drawing Sheets

DUAL BIN PAPER FEED TRAY FOR AN IMAGE REPRODUCTION MACHINE SUCH AS A PRINTER OR COPIER

BACKGROUND OF THE INVENTION

1. Field of the Invention

The present invention relates generally to image reproduction machinery, and more particularly relates to paper feed apparatus for printers, copiers and the like.

2. Description of Related Art

Modern image reproduction machines, such as printers and copiers, are typically provided with one or more paper supply trays, each of which is removably insertable into an associated opening formed in the outer housing of the machine. Each tray is adapted to hold a stack of cut paper sheets—typically of 8½"×11" or 8½"×14" size-for infeed to the internal printing portion of the machine and subsequent discharge from the machine housing into an external paper receiving structure.

Cut paper sheet stock of this type is typically sold in individually wrapped one ream packages (one ream being 500 sheets), and paper trays for printers and copiers are conventionally sized to hold a maximum of 250 sheets—i.e., half of the usual one ream package. Particularly in larger printing or copying "runs" it would be desirable to increase the sheet holding capacity of paper supply trays (preferably to a size capable of holding an entire one ream package of cut paper sheets) to reduce the frequency of manually reloading the tray.

One previously proposed method of permitting the operative loading of an entire one ream package into a paper feed tray has been to simply double the paper receiving and storage depth of the tray so that it is capable of holding a 500 sheet stack instead of the usual 250 sheet stack. While at first glance this seems to be a logical, straightforward approach to increasing the holding capacity of a paper supply tray it requires, of course, that the height of the housing opening be correspondingly increased to accommodate the now much deeper tray. This undesirably increases the overall height of the machine. It additionally requires that all other paper supply trays (and envelope feed trays) used with the particular machine have their depths accordingly increased to fit the enlarged housing opening.

In view of the foregoing, it is accordingly an object of the present invention to provide a paper feed tray with increased paper holding capacity, preferably a full one ream capacity, without appreciably increasing its depth.

SUMMARY OF THE INVENTION

In carrying out principles of the present invention, in accordance with a preferred embodiment thereof, an image reproduction machine, representatively a laser printer, is provided with a dual bin paper feed tray adapted to support front and rear stacks of cut paper sheets for infeed into the machine through its normal paper supply feed path. The dual bin paper feed tray is insertable, front paper stack first, into the standard height machine housing opening which normally receives a conventional paper feed tray sized to hold only a single stack of cut paper sheets-typically 250 sheets or half of the usual one ream package of printer or copier paper. Because of its unique provision of front and rear paper stack-receiving bins, each preferably sized to hold the paper contents of a conventional single bin tray, the dual bin tray of the present invention is conveniently capable of holding an entire one ream package of paper for infeed to the machine by its existing paper feed means.

The paper feed tray of the present invention basically comprises wall means for defining a paper feed tray having front and rear ends and being forwardly insertable into the housing opening, and bin-defining means which operate to define in the paper feed tray front and rear bin areas respectively configured to receive and support front and rear stacks of cut paper sheets. Holding means associated with the front bin area are operative to receive and grip the front paper sheet stack in a manner facilitating the sequential infeed of its paper sheets into the machine, via the operation of the machine's feed means, when the loaded paper feed tray is operatively inserted into the machine housing. Shifting means are associated with the rear bin area and are operable to forwardly move the rear stack of cut paper sheets from the rear bin area into the front bin area, and into gripped engagement by the holding means, when the front bin area paper supply is emptied by the machine's feed means. The rear paper stack, now operatively disposed in the front bin area, is thus readied for infeed to the machine.

In a motor-driven, automatic embodiment of the paper tray, the holding means include a base plate member adapted to underlie and support the front paper stack, the base plate member having a rear edge portion pivotally secured to a bottom rear portion of the front bin area. Spring means are provided to pivotally bias the base plate member in an upward direction to cause a front edge portion of the front paper stack to be gripped between the base plate and tab means which overlie a front side edge of the base plate.

The shifting means, operative in response to a sensed emptying of paper from the front bin area, include a pusher plate movable by a reversible electric motor to travel forwardly through the rear bin area, to push the rear paper stack into the empty front bin area, and then be motor-driven rearwardly to a rear limit position. The shifting means also include means for downwardly pivoting the base plate and raising the tab means, in response to forward movement of the pusher plate, to facilitate operative loading of the rear paper stack into the front bin area, and for permitting the base plate and tab means to return to their normal operating positions as the pusher plate returns to its rear limit position.

The bin-defining means include a pair of spring mounted divider members projecting inwardly from opposite sides of the tray and serving to partially separate the front and rear bin areas and form backstops for the front paper stack. With the pusher plate in its rear limit position, locking means are operative to hold the divider means in their normal backstop positions. However, in response to forward driven movement of the pusher plate the locking means are released to permit the forwardly moving rear paper stack to move the divider members horizontally outwardly and thereby permit entry of the rear paper stack into the empty front bin area. When the rear paper stack fully enters the front bin area the divider members are spring-returned to their backstop positions, and as the pusher plate is moved rearwardly toward its rear limit position the locking means are operated to re-lock the divider members in their backstop position.

In a manually operable embodiment of the dual bin paper tray the motor drive system is deleted, and the pusher plate is replaced with an auxiliary paper tray slidably disposed within the rear bin area and adapted to receive and support the rear paper stack. The auxiliary tray has side tabs which are received in slots formed in opposed side wall portions of the main tray. When the front paper stack is used up, the auxiliary tray is manually pushed forwardly into the front bin area. As the auxiliary tray enters the front bin area it forcibly pivots the support plate downwardly and rides up over the support plate. When the auxiliarly tray is fully inserted into the front bin area, front tab portions of the auxiliary tray exit the side wall slots, thereby permitting the support plate spring means to upwardly pivot the auxiliary tray and operatively bring a front edge portion of the forwardly repositioned rear paper stack into engagement with the aforementioned tab means.

DETAILED DESCRIPTION

Figure 1:
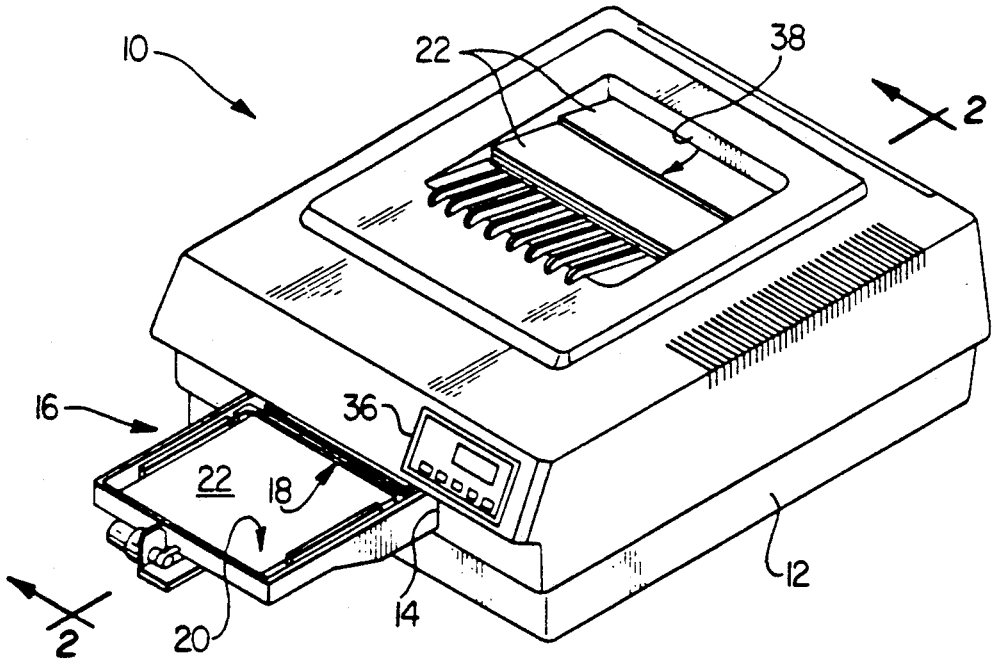
FIG. 1 is a perspective view of an image reproduction machine, representatively in the form of a laser printer, having a specially designed dual bin paper feed tray operatively inserted in an opening in the machine housing and embodying principles of the present invention.
Figure 2:
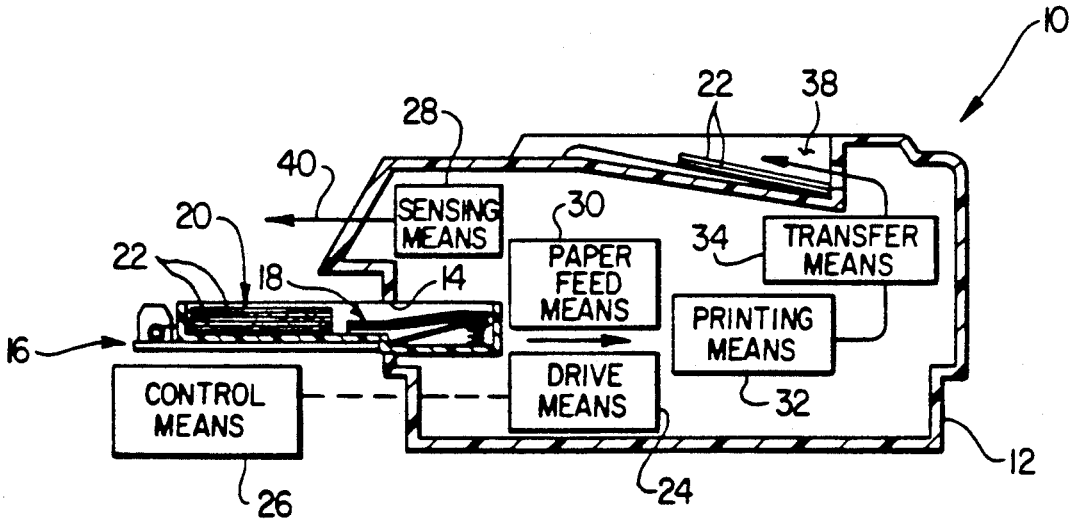
FIG. 2 is a cross-sectional view through the printer and tray taken along line 2—2 of FIG. 1 and further illustrating, in schematic form, various controls associated with the printer and tray.

Referring initially to FIGS. 1 and 2, the present invention provides an improved image reproduction machine which is representatively illustrated as being a laser printer 10, although it could alternatively be another type of image reproduction machine such as a copier or non-laser type printer. Laser printer 10 includes a housing 12 having a front opening 14 therein which removably receives a specially designed dual bin paper feed tray 16 that embodies principles of the present invention and, in a manner subsequently described, is adapted to receive and support front and rear stacks 18, 20 of cut paper sheets 22 for infeed to the printer 10.

The dual bin paper feed tray 16 is conveniently sized so that each of the front and rear paper stacks 18, 20 may hold 250 sheets of cut paper, thereby permitting the tray 16 to be operatively loaded with a full one ream package of paper. The illustrated paper sheets 22 are representatively shown as being a standard 8½"×11" size, with the long dimensions of the sheets being disposed at the front and rear sides of the paper stacks so that, in a manner subsequently described, the sheets 22 are fed sideways into the printer 10.

As shown in FIG. 2, the printer 10 is provided with schematically depicted drive means 24, control means 26, paper sensing means 28, paper feed means 30, printing means 32, and paper transfer means 34—all of generally conventional construction and operation. The control means 26 are conveniently positioned on a small control panel 36 (FIG. 1) disposed on the front side of the printer housing 12. During operation of the printer 10 with the loaded tray 16 forwardly inserted into the housing opening 14, the paper feed means 30 are regulated by the control means 26 to sequentially feed paper sheets 22 from the top of the front stack 18 into the interior of the housing 12. Sheets 22 exiting tray 16 from the front stack 18 are delivered, by drive means 24, to the printing means 32 which suitably imprint the sheets. The printed sheets 22 exiting the printing means 32 are delivered by the transfer means 34 to an external receiving well area 38 recessed into the top side of the printer housing 12.

During the infeed of the sheets 22 from the front paper stack 18 into the housing 12, the sensing means 28, in a conventional manner, continuously monitor the presence of paper in the front stack 18. Upon detecting that the front paper stack 18 has been entirely depleted, the sensing means 28 output an appropriate "paper empty" control signal 40. In a manner subsequently described, a unique shifting mechanism in the tray 16 is then operated in response to signal 40 to forwardly move the rear paper stack 20 to the tray area previously occupied by the now-depleted front stack 18, thereby automatically readying the rear stack 20 for infeed to the printer by the paper feed means 30 and uniquely doubling the paper storage and feed capacity of the tray 16 without requiring an increase in the height of the housing opening 14.

Figure 3A:
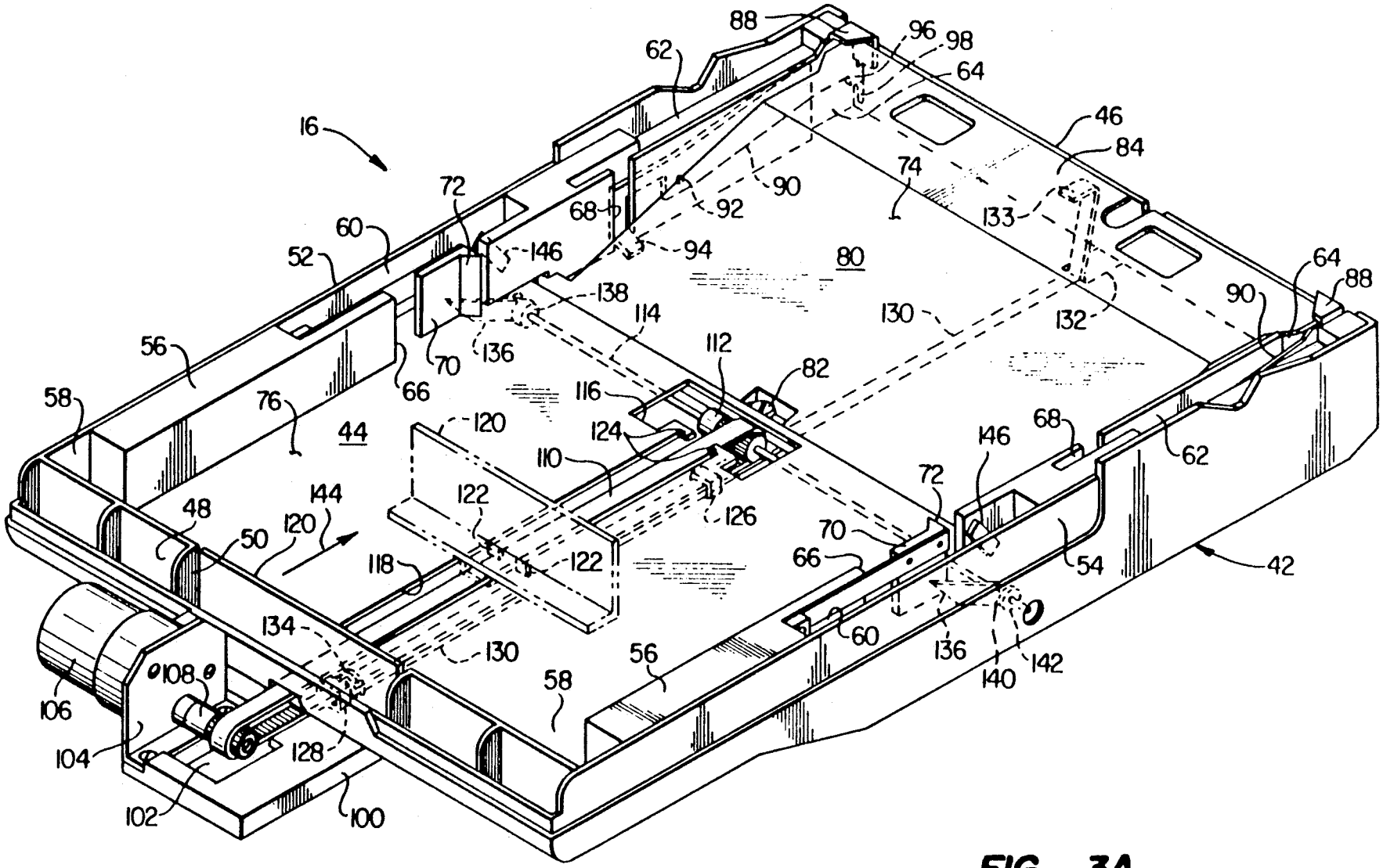
FIG. 3A is an enlarged scale perspective view of the tray illustrating in phantom a partial forward movement of a rear pusher plate portion of the tray which initiates a downward pivotal movement of a forwardly disposed support plate portion of the tray.
Figure 3B:
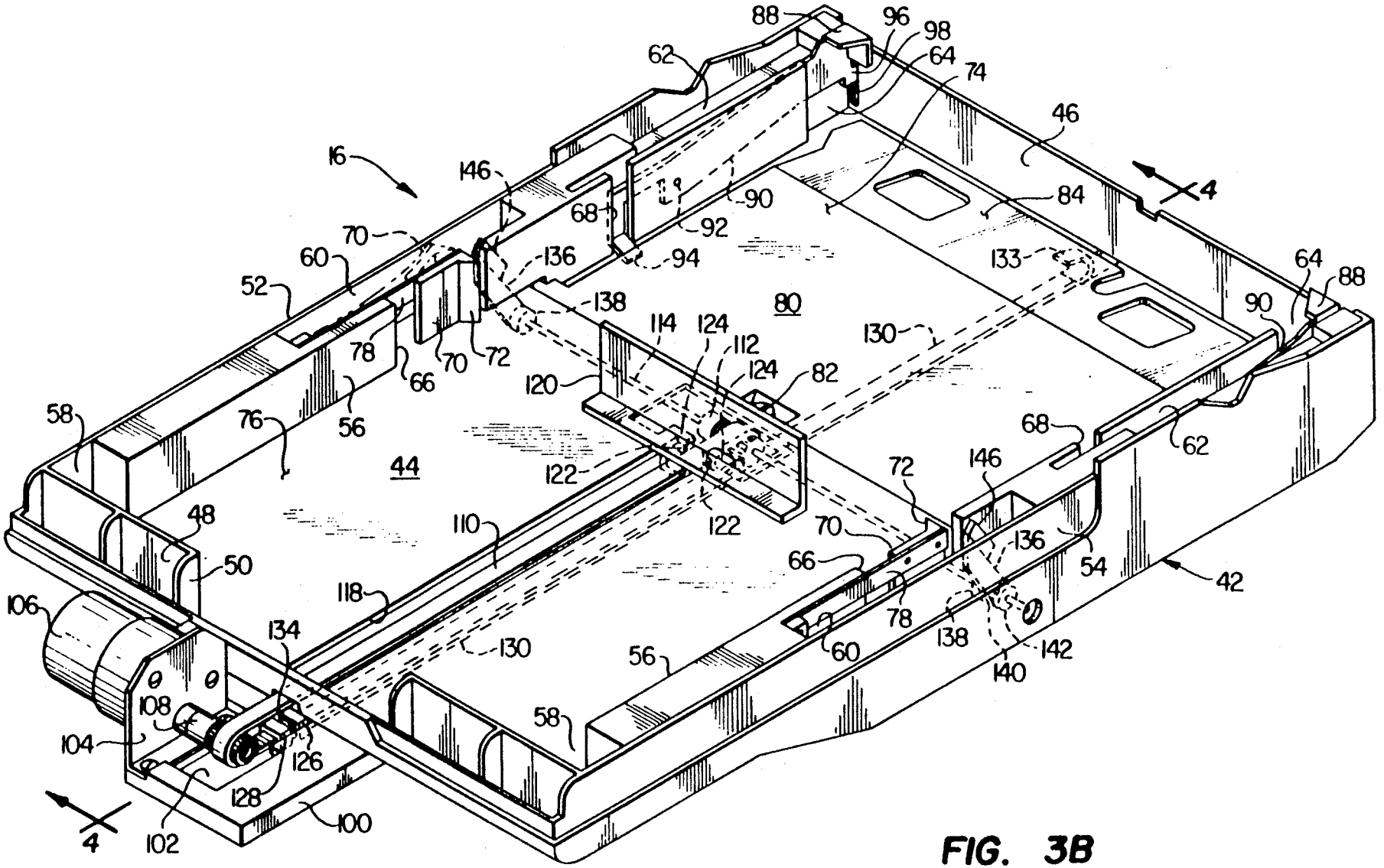
FIG. 3B is a perspective view of the tray similar to that in FIG. 3A but with the pusher plate moved to its forward limit position, and the support plate downwardly pivoted to its lower limit position.
Figure 4:
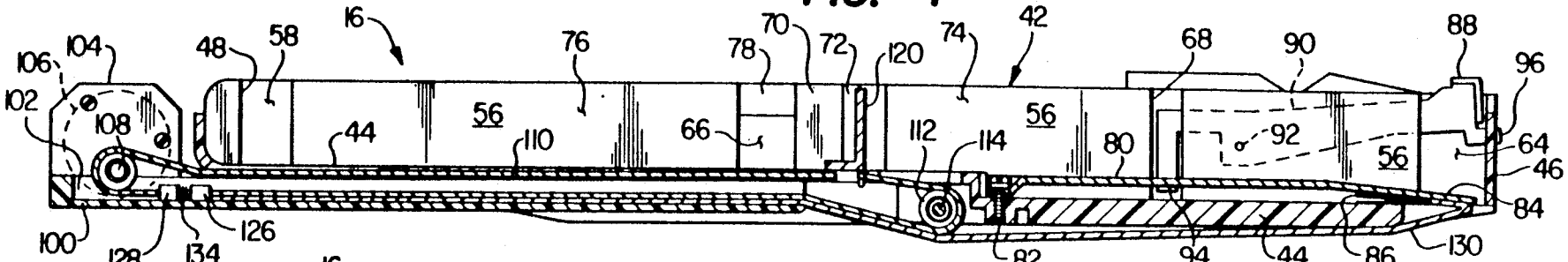
FIG. 4 is a cross-sectional view through the tray taken along line 4—4 of FIG. 3B.

Turning now to FIGS. 3A, 3B and 4, the dual bin paper tray 16 includes an elongated rectangular tray structure 42 having an open top side, a bottom wall 44, a front end wall 46, a rear end wall 48 having a central gap 50 formed therein, and a pair of exterior left and right outer side walls 52 and 54. Extending along the inner sides of the opposite tray walls 52, 54 are thickened inner side wall structures 56 having, from left to right, cut out areas 58, 60, 62 and 64. The cut out areas 60 and 62 communicate with the interior of the tray structure 42 between the inner side wall structure 56 via slots 66 and 68 formed in the inner sides of the wall structures 56.

Disposed in the slots 66 are a pair of divider members 70 having front end portions 72 that project outwardly beyond the slotted areas 66 and serve to partially separate the interior of the tray structure 42 into front and rear bin areas 74 and 76 respectively configured to closely receive and operatively support the front and rear paper stacks 18 and 20, respectively. The divider members 70 are supported on the inner side wall structure 56 by elongated thin metal spring members 78 which, for purposes later described, permit the divider members 70 to be resiliently deflected into their associated side wall cut out areas 60 as indicated by the dotted line position of the left divider member 70 in FIG. 3B.

Positioned in the front bin area 74 is a rectangular support plate 80 having a rear edge portion pivotally secured to the bottom tray wall 44 by a screw 82, and a slightly downwardly bent front side edge portion 84. The support plate 80 is pivotable about the screw 82 between an upper limit position (FIG. 3A) and a lower limit position (FIG. 4). Support plate 80 is pivotally biased, in a counterclockwise direction, toward its upper limit position by a pair of cylindrical spring members 86 which bear at their opposite ends against the lower tray wall 44 and the underside of the support member front edge portion 84 as illustrated in FIG. 4.

With the support plate 80 in its upper limit position, front corner portions of the support plate upwardly engage the inturned front end tab portions 88 of a pair of elongated paper support bars 90 which are pivoted, as at 92, within the cut out areas 62 and have rear end tab portions 94 which project outwardly through the side wall slots 68 and underlie the support plate 80. For purposes later described, the front ends of the support bars 90 are also provided with forwardly projecting tabs 96 received in vertically elongated slots 98 formed through the front end wall 46 of the tray structure 42.

An elongated support bar member 100, having a longitudinally extending trough 102 formed in its upper side surface, is suitably affixed to the underside of the tray structure beneath the rear bin area 76, with a left end portion of the support bar 100 projecting leftwardly beyond the rear end wall 48 of the tray structure 42. A mounting bracket 104 is secured to the left end of the support bar 100 and supports a reversible electric drive motor 106 having an output shaft 108. The left end of an endless drive belt 110 is drivably looped around the motor shaft 108, while the right end of the belt 110 is drivingly looped around a radially enlarged central portion 112 of an elongated shaft 114 which is positioned beneath a rear section of the front bin area 74 and is journaled at its opposite ends in the tray side walls 52 and 54. The radially enlarged shaft portion 112 is positioned beneath a cut out area 116 formed through the bottom tray wall 44 directly behind the pivoted support plate 80. The top side of the belt 110 is recessed into an elongated through 118 formed in the top side of the bottom tray wall 44 within the rear bin area 76, while the bottom side of the belt 110 is disposed within the elongated through 102 extending along the length of the top side of the support bar member 100.

An upstanding pusher plate member 120 is suitably anchored to the top side of the belt 110 and has a pair of stop tabs 122 which extend down into the trough 118 and straddle the top side of the belt 110. As can be seen by comparing the solid line positions of the pusher plate 120 in FIGS. 3A and 3B, rotation of the motor shaft 108 in appropriate directions is operative to move the pusher plate 120 forwardly and rearwardly along the bottom of the tray structure 42 between a rear limit position (FIG. 3A) in which the pusher plate is disposed within the rear end wall gap 50 of the tray, and a forward limit position (FIG. 3B) in which the pusher plate is adjacent the radially enlarged portion 112 of the transverse shaft 114. In the forward limit position of the pusher plate 120, the pusher plate tabs 122 engage an inturned pair of stop tabs 124 at the right end of the trough 118.

For purposes later described, a small hollow stop block member 126 is anchored to the bottom side of the belt 110 and rides in the trough 102 on the upper side of the support bar member 100. Circumscribing the lower side of the belt 110 to the left of the stop block 126 is a small hollow stop block member 128 which also rides in the trough 102. The block 128 is anchored to the left end of an elongated flexible belt member 130 which longitudinally extends in a front-to-rear direction beneath the bottom wall 44 of the tray structure 42. As best illustrated in FIG. 3A, a right end portion of the belt member 130 extends upwardly through an opening 132 in front end of the bottom tray wall 44, and is secured, as at 133, to the underside of the front portion 84 of the support plate 80. The belt member 130 is slidably extended leftwardly through the stop block 126, and the stop block 128 permits sliding movement of the lower side of the belt 110 therethrough. Secured to the stop block 128, and projecting rightwardly therefrom, is a small spring member 134.

When the pusher plate 120 is in its solid line rear limit position shown in FIG. 3A, the stop block 126 is positioned adjacent the trough tabs 124, and the support plate 80 is pivotally biased to its upper limit position by the coil springs 86. The divider members 70 are prevented from being deflected into their associated cut out areas 60 by a pair of elongated locking members 136 which are disposed within the cut out areas 60 and engage the outer sides of the divider members 70. At their inner ends, the locking members 136 are frictionally connected to the transverse shaft 114 and abut radially enlarged portions 138 thereon, the inner ends of the locking members 136 being frictionally held against the radially enlarged shaft portions 138 by means of wavy wahsers 140 and snap rings 142. This frictional securement of the locking members 136 to the transverse shaft 114 permits the locking members to be rotated by the shaft, but also permits the locking members to be manually rotated relative to the shaft 114 if desired.

Still referring to FIG. 3A, a clockwise rotation of the motor shaft 108 drives the pusher plate rightwardly from its solid line, rear limit position toward its front limit position (shown in FIGS. 3B and 4) as indicated by the arrow 144 and the dotted line position of the pusher plate 120. As the pusher plate 120 is moved rightwardly, the clockwise rotation of the belt 110 moves the stop block 126 leftwardly along the belt 130 until the stop block 126 engages the spring portion 134 of the stop block 128. Further rightward driven movement of the pusher plate 120 causes the leftwardly moving block 126 to drive the stop block 128 leftwardly toward its position depicted in FIG. 3B. In turn, the leftward movement of the block 128 pulls the belt 130 in a leftward direction to downwardly pivot the support plate 80 toward its lower limit position.

As the support plate 80 downwardly approaches its lower limit position, the support plate engages the rear end tab portions 94 of the paper support bars 90 and correspondingly causes the support bars 90 to be pivoted in a counterclockwise direction to thereby lift the front tabs 88 thereof as may be seen by comparing FIG. 3A to FIG. 4. The clockwise rotation of the belt 110 which rightwardly drives the pusher plate 120 also causes the locking members 136 to be pivoted in a clockwise direction until they are disengaged from the back sides of the divider members 70. Further clockwise rotation of the locking members 136 drives them into engagement with a pair of stop members 146 disposed within the cut out areas 60 (FIG. 3B), thereby permitting the divider members 70 to be resiliently deflected into the cut out areas 60 in a manner subsequently described. Still further clockwise rotation of the belt 110 after the locking members 136 have engaged their associated stop members 146 simply causes the transverse shaft 114 to be rotated relative to the stopped blocking members 136.

When the pusher plate 120 reaches its forward limit position depicted in FIG. 3B, the support plate 80 is in its lower limit position, the front tabs 88 of the paper support bars 90 are pivoted upwardly, and the pusher plate stop tabs 122 are forced into engagement with the trough tabs 124. The engagement between the tabs 122, 124 creates an overload condition in the drive motor 106 which is appropriately sensed and used to reverse the drive direction of the motor 106 and return the pusher plate 120 from its forward limit position (FIG. 3B) to its rear limit position shown in FIG. 3A. The return of the pusher plate 120 to its rear limit position returns the locking members 136 to their divider member locking positions, and also moves the stop block 126 out of engagement with the stop block 128 to permit the support plate 80 to be returned to its upper limit position by the springs 86. The return of the support plate 80 to its upper limit position permits the paper support bars 90 to be pivoted by gravity back to their FIG. 3A positions, the tabs 96 sliding downwardly in the front end wall slots 98.

Figure 5A:
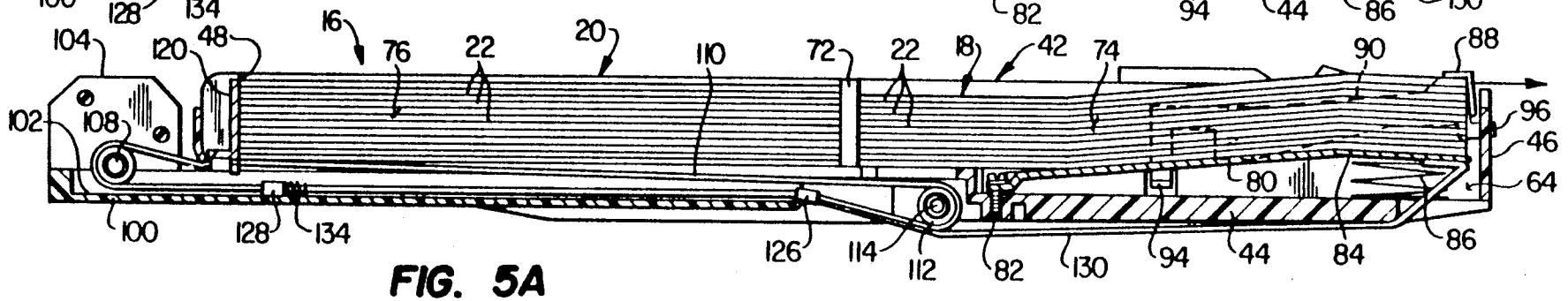
FIGS. 5A-5C are cross-sectional views through the tray sequentially illustrating the manner in which it is motor-driven to feed front and rear stacks of cut paper sheets to the printer.
Figure 5B:
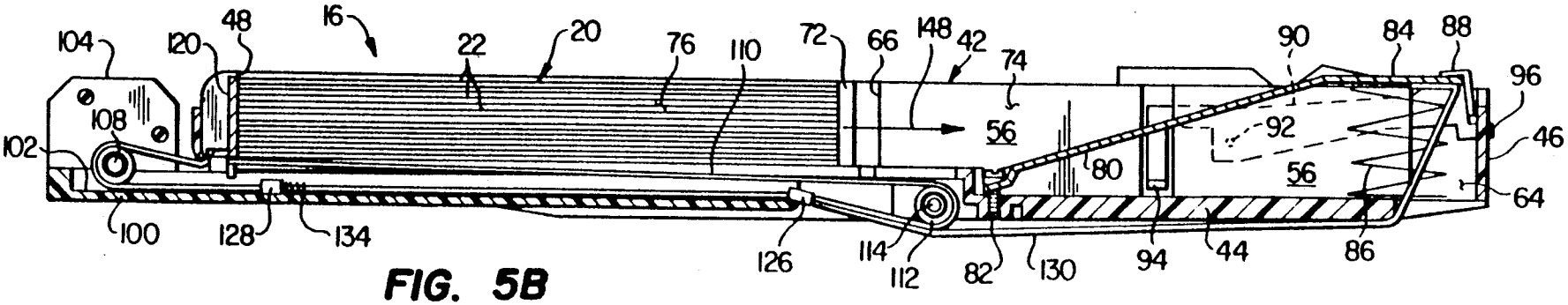

The cooperation between and among the various structural elements of the dual bin paper tray 16 just discussed is utilized to uniquely handle the front and rear paper stacks 18 and 20 in a manner which will now be described in conjunction with FIGS. 5A–5C. Referring intially to FIG. 5A, with the tray 16 removed from the housing opening 14, and the pusher plate 120 moved to its rear limit position, the rear paper stack 20 is simply dropped into the rear bin area 76. The front paper stack 18 is inserted into the front bin area 74 by manually depressing the support plate 80 to its lower limit position, inserting the paper stack 18 into the front bin area, and positioning a front edge portion of the front paper stack between the front portion 84 of the support plate and the now elevated front tab portions 88 of the paper support bars 90. The inserted front paper stack 18 is then released to permit the springs 86 to pivot the depressed support plate 80 upwardly until a front edge portion of the inserted front paper stack 18 is operatively gripped between the front support plate portion 84 and the tabs 88 to facilitate the infeed of the sheets 22 in the front paper stack into the machine housing by the previously mentioned paper feed means 30 (FIG. 2).

The loaded paper tray 16 is then forwardly inserted into the housing opening 14 as shown in FIG. 2, thereby readying the printer 10 for operation. On demand, the paper feed means 30 operate to sequentially feed paper sheets 22 from the front paper stack 18, from the top of the stack 18, into the printer 10. When the front bin area 74 has been emptied, as depicted in FIG. 5B, the paper sensing means 28 detect the absence of paper in the front bin area and responsively generate the previously mentioned "paper empty" signal 40 (FIG. 2) which is utilized to energize the drive motor 106 to initiate a clockwise rotation of the drive belt 110. The clockwise rotation of the drive belt 110, as previously described, initiates a forward movement of the pusher plate 120 as indicated by the arrow 148 in FIG. 5B.

Just after the pusher plate 120 begins its rightward movement, the locking members 136 are pivoted to their unlocked position which permits the forward movement of the opposite front corners of the rear paper stack 20 to outwardly deflect the divider members 70 into their associated cut out areas 60 (FIG. 3B), thereby permitting the rear paper stack 20 to be moved forwardly beyond the deflected divider members 70 and into the front bin area 74. Further rightward movement of the pusher plate 120, as also previously described, pivots the support plate 80 downwardly toward its lower limit position and continues to move the rear paper stack 20 into the front bin area 74. As the front end of the paper stack 20 approaches the front end of the tray structure 42, the pusher plate approaches its forward limit position (FIG. 5C) and the tabs 88 are automatically lifted to facilitate the entry of the front end of the paper stack 20 between the support plate portion 84 and the tabs 88.

Figure 5C:
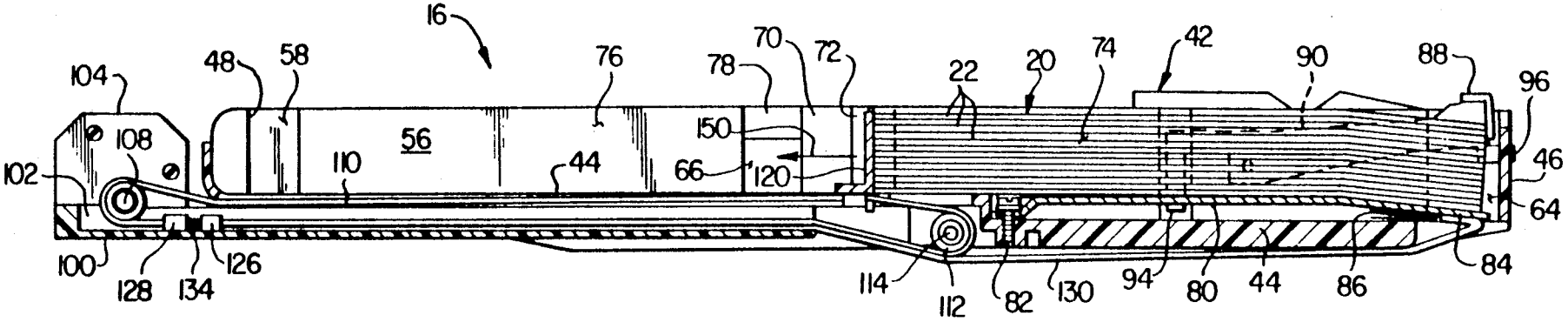

When the pusher plate 120 reaches its forward limit position, as illustrated in FIG. 5C the rear paper stack 20 has been fully inserted into the front bin area 74, and the divider members 70 are spring-returned to their non-deflected positions in which front portions of the divider members 70 act as back stops for the rear paper stack 20 now disposed in the front bin area 74. As previously described, when the pusher plate 120 reaches it forward limit position, the drive motor 106 is automatically caused to reverse, thereby returning the pusher plate 120 to its rear limit position as indicated by the arrow 150. Such movement of the pusher plate 120 toward its rear limit position permits the springs 86 to pivot the support plate 80 upwardly toward its upper limit position to operatively grip front corner portions of the paper stack 20 between the front support plate portion 84 and the tabs 88, thereby readying the now shifted rear paper stack 20 to be infed to the printer 10.

In this simple manner, an entire one ream package of cut paper sheets may be loaded into the tray 16, thereby doubling its paper storage and feed capacity without increasing the height of the housing opening 14. The components and mechanisms used to effect this unique forward shifting of the rear paper stack into the emptied front bin area are relatively simple and inexpensive, and are of a reliable and rugged construction. The tray 16 is, for the most part, able to utilize the standard operating and control systems and components normally provided in the printer 10, or other image reproduction machines such as copiers or non-laser printers.

Figure 7A:
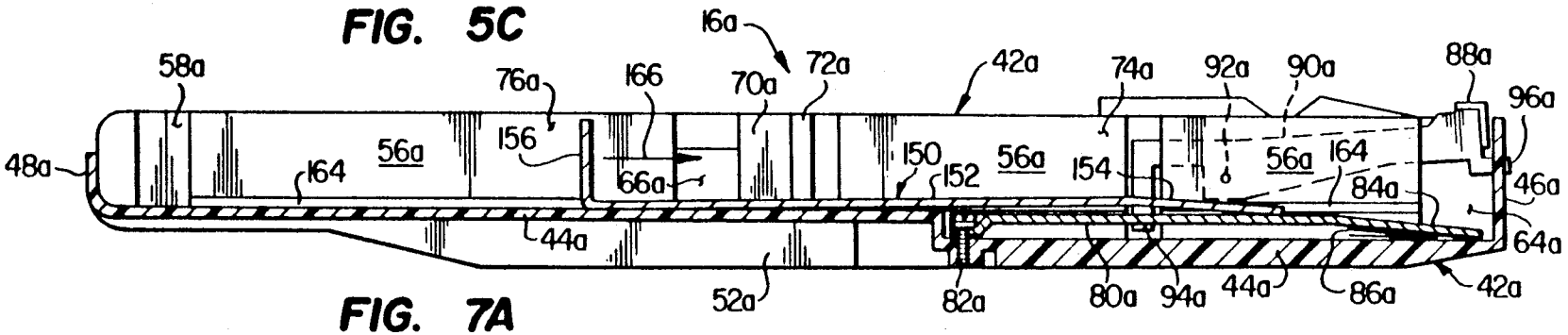
FIG. 7A is a cross-sectional view through the manually operable tray, taken along line 7A—7A of FIG. 6, with a rearwardly disposed auxiliary tray portion thereof being moved partially toward a forward limit position thereof and initiating a downward pivotal movement of the forwardly disposed support plate.
Figure 7B:
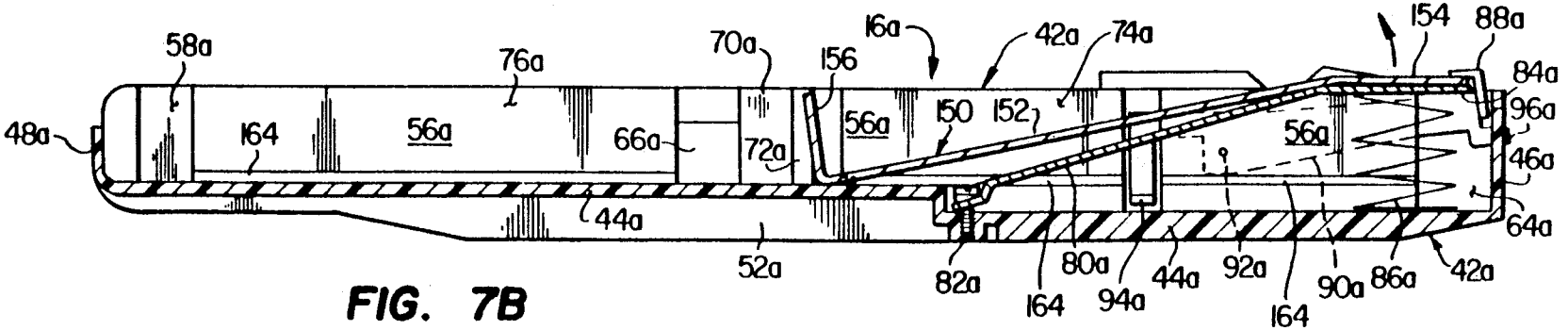
FIG. 7B is a cross-sectional view similar to that in FIG. 7A, but with the auxiliary tray moved to its forward limit position and the support plate and auxiliary tray upwardly pivoted to upper limit positions thereof.
Figure 6:
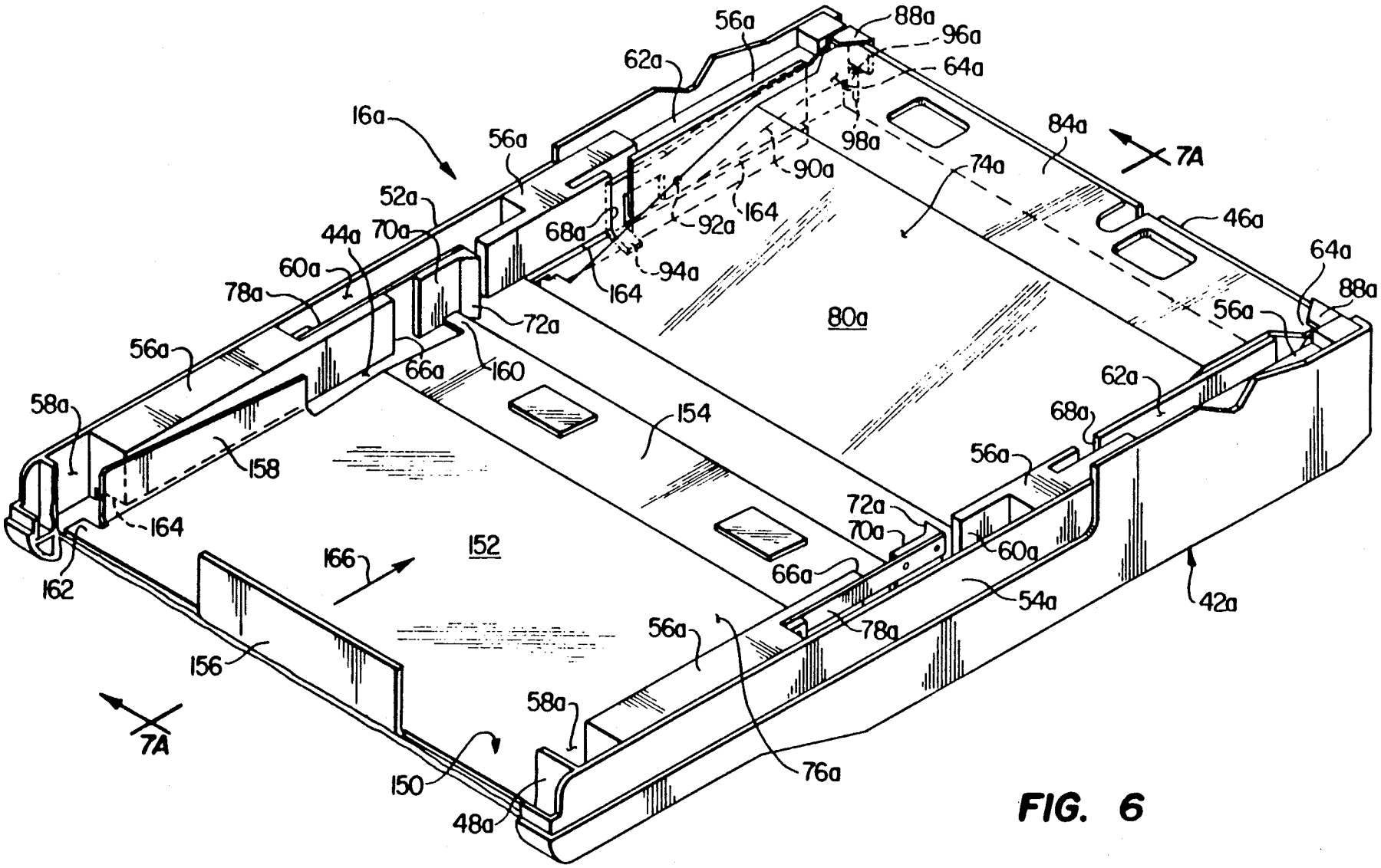
FIG. 6 is a partially cut away perspective view of an alternate, manually operable embodiment of the dual bin paper tray.

An alternate embodiment **16*a* of the dual bin paper tray 16 is depicted in FIGS. 6, 7A and 7B and is similar to tray 16 except that the previously described shifting of the rear paper stack into the emptied front bin area is effected manually instead of automatically. For ease of comparison, parts in the tray 16*a* similar to those in tray 16** have been given identical reference numerals having the subscripts "a".

In the manually operable tray **16*a*, the previously described support bar 100, drive motor 106, belts 110 and 130, shaft 114, and pusher plate 120 are deleted. In place of these motor-driven shifting means, an auxiliary paper tray 150** is utilized to operatively support the rear paper stack and manually shift it into the emptied front bin area.

The auxiliary tray 150 has a generally rectangular shape, and is configured to be closely received within the rear bin area 76a as depicted in FIG. 6. The tray 150 has a bottom wall 152 with a slightly downwardly bent front side portion 154, an upwardly bent rear end support tab 156, a pair of opposed, upwardly bent rear side support tabs 158, a pair of laterally outwardly projecting front corner guide tabs 160, and a pair of laterally outwardly projecting rear corner guide tabs 162. For purposes later described, grooves 164 are formed laterally inwardly through the undersides of the opposed pair of the thickened inner side wall structures 56a.

With the auxiliary tray 150 in its rear limit position within the rear bin area 76a as shown in FIG. 6, the front corner guide tabs 160 are rearwardly adjacent the front end portions 72a of the divider members 70a, and the rear corner guide tabs 162 project into the rear cut out areas 58a. The rear paper stack is simply dropped into the auxiliary tray 150 so that the rear side of the paper stack is positioned against the rear end tab 156, and the front side of the stack is just to the rear of the divider member front portions 72a. The front paper stack is loaded into the front bin area 74a, as previously described, simply by depressing the support plate 80a, positioning the rear side of the front paper stack against the front side of the front divider member portions 72a, inserting the front side of the front paper stack between the support plate front portion 84a and the elevated support tabs 88a, and then releasing the paper stack so that front corner portions thereof are operatively gripped between the support plate portion 84a and the overlying tabs 88a. The loaded dual bin paper tray 16a is then forwardly inserted into the housing opening 14 of the printer 10.

Referring now to FIGS. 7A and 7B (in which the loaded front and rear paper stacks have been omitted for illustrative clarity), after the front paper stack has been emptied from the front bin area 74a by the previously mentioned paper feed means 30 (FIG. 2), the paper sensing means 28 may be utilized to transmit a visual "paper empty" signal which appears on the control panel 36 (FIG. 1). When this situation occurs, the printer operator simply pushes the auxiliary paper tray rear end tab 156 forwardly (as indicated by the arrows 166 in FIGS. 6 and 7A) to move the auxiliary paper tray 150 and its supported rear paper stack forwardly along the interior of the tray structure 42a. Locking means (not shown) similar to the previously described locking members 136 may be pivotally secured to the side wall portions 56, and manually operated to selectively lock and unlock the divider members 70a.

As the auxiliary tray 150 is pushed forwardly, the front corner tabs 160 outwardly deflect the divider members 70a to permit the initial entry of the rear paper stack into the emptied front bin area 74a, and the front and rear corner tabs 160, 162 enter the side wall structure grooves 164, thereby restraining the auxiliary tray 150 against upward movement relative to the tray structure 42a. Further forward movement of the auxiliary tray 150 causes its front portion 154 to ride up over the support plate 80a and force it downwardly to its lower limit position, thereby raising the tabs 88a, as the rear paper stack carried by the auxiliary tray 150 enters the front bin area. As illustrated in FIG. 7B, when the auxiliary tray 150 is pushed fully into the front bin area 74a, the front corner tabs 160 (FIG. 6) rightwardly exit the slots 164 as the rear corner tabs 162 enter the slot portions just to the right of the side wall slots 66a (FIG. 6).

The exiting of the front corner tabs 160 from the right ends of the side wall slots 164 permits the springs 86a to upwardly pivot the support plate 80a, and the auxiliary tray 150 which overlies the support plate, toward their upper limit positions depicted in FIG. 7B, the rear end of the auxiliary tray 150 being restrained within the side wall slots 164 to permit this upward pivoting of the auxiliary tray. Upward pivoting of the auxiliary tray 150 causes front corner portions of the forwardly shifted rear paper stack to be operatively gripped between the front portion 154 of the auxiliary tray 150 and the overlying tabs 88a. This simple forward manual shifting of the auxiliary tray 150 operatively positions the rear paper stack within the front bin area 74a so that the sheets 22 in the repositioned rear paper stack may be infed to the printer 10 until the rear paper stack is depleted, at which point the front auxiliary tray portion 154 engages the tabs 88a (as illustrated in FIG. 7B) and the sensing means 28 create a visual signal on the control panel 36 indicating that the second paper stack has now been used up.

The foregoing detailed description is to be clearly understood as being given by way of illustration and example only, the spirit and scope of the present invention being limited solely by the appended claims.

What is claimed is:

1. A method of supplying paper to an image reproduction machine, such as a printer or copier, having a housing, an opening formed in said housing, feed means operative to feed paper into said housing from a paper supply stack disposed adjacent said opening, and printing means for imprinting paper fed into said housing, said method comprising the steps of:

loading front and rear stacks of cut paper sheets respectively into front and rear areas of a paper feed tray;

forwardly inserting the loaded paper feed tray into said housing opening;

utilizing said feed means to sequentially feed paper sheets from said front stack into said machine until said front stack is totally depleted;

moving said rear stack from the rear tray area into the front tray area previously occupied by said front stack; and utilizing said feed means to sequentially feed paper sheets into said image reproduction machine from the rear stack disposed in said front tray area.

2. The method of claim 1 wherein:

said method further comprises the step of sensing the total depletion of said front stack by said feed means.

said loading step includes the step of loading the rear stack of cut paper sheets into a movable portion of the paper feed tray, and said moving step includes the step of forwardly moving said movable portion of the paper feed tray in response to the sensed total depletion of said front stack by said feed means.

3. The method of claim 1 wherein:

said loading step includes the step of loading said rear stack into an auxiliary tray movably received in said rear area of said paper tray, and said moving step is performed by manually moving said auxiliary tray into said front tray area.

4. Paper supply apparatus for supplying paper to an image reproduction machine having a housing, an opening formed in said housing, feed means operative to feed paper into said housing from a paper supply stack disposed adjacent said opening, and printing means for imprinting paper fed into said housing, said paper supply apparatus comprising:

wall means for defining a paper feed tray having front and rear ends and being forwardly insertable into said housing opening;

bin-defining means for defining in said paper feed tray front and rear bin areas respectively configured to receive and support front and rear stacks of cut paper sheets;

holding means, associated with said front bin area, for receiving the front paper sheet stack and gripping it in a manner facilitating the sequential infeed of its paper sheets into said machine by said feed means when said paper feed tray is inserted into said housing opening; and shifting means associated with said rear bin area and operable to shift the rear stack of cut paper sheets into said front bin area, and into gripped engagement by said holding means, when said front bin area is empty.

5. The paper supply apparatus of claim 4 wherein:

each of said front and rear bin areas is configured to operatively receive and support a stack of cut paper sheets having approximately 250 sheets of paper therein.

6. The paper supply apparatus of claim 4 wherein:

said machine has paper sensing means therein for detecting the total depletion of a stack of paper being fed thereto and responsively generating an output signal indicative of such depletion, and said shifting means are automatically operable in response to the generation of said output signal.

7. The paper supply apparatus of claim 4 wherein: said shifting means are manually operable.

8. The paper supply apparatus of claim 4 wherein:

said holding means are movable between a paper receiving position and a paper gripping position, and said shifting means are further operable to sequentially move said holding means from said paper gripping position to said paper receiving position and then back to said paper gripping position.

9. The paper supply apparatus of claim 4 wherein:

said bin-defining means include divider means projecting into opposite sides of the tray interior between said front and rear bin areas, said divider means being operative to separate said front and rear stacks and act as a backstop for the front paper stack, and being resiliently deflectable to permit passage of said rear paper stack into said front bin area.

10. The paper supply apparatus of claim 9 further comprising:

locking means for selectively preventing said lateral deflection of said divider means.

11. The paper supply apparatus of claim 10 wherein:

said shifting means are operative, during forward movement of said rear paper stack, to release said locking means and permit said lateral deflection of said divider means.

12. Paper supply apparatus for supplying paper to an image reproduction machine having a housing, an opening formed in said housing, feed means operative to feed paper into said housing from a paper supply stack disposed adjacent said opening, and printing means for imprinting paper fed into said housing, said paper supply apparatus comprising:

wall means for defining a paper feed tray having front and rear ends and being forwardly insertable into said housing opening;

bin-defining means for defining in said paper feed tray front and rear bin areas respectively configured to receive and support front and rear stacks of cut paper sheets;

holding means, associated with said front bin area, for receiving the front paper sheet stack and gripping it in a manner facilitating the sequential infeed of its paper sheets into said machine by said feed means when said paper feed tray is inserted into said housing opening, said holding means including:

a base plate member adapted to underlie and support the front stack of cut paper sheets, said base plate member having a rear edge portion pivotally secured to a bottom rear portion of said front bin area, spring means for pivotally biasing said base plate member in an upward direction, and support tab means for overlying and engaging front edge portions of the front paper sheet stack;

shifting means associated with said rear bin area and operable to forwardly move the rear stack of cut paper sheets from said rear bin area into said front bin area, and into gripped engagement between said base plate member and said support tab means, when said front bin area is empty, said shifting means including means, operative during forward movement of said rear stack of paper sheets into said front bin area, for downwardly pivoting said base plate member to facilitate the operative reception of said rear stack of cut paper sheets between said base plate member and said support tab means.

13. The paper supply apparatus of claim 12 wherein:

said support tab means are secured to said tray for pivotal movement relative thereto between upper and lower limit positions, and said shifting means further include means, operative during forward movement of said rear stack of paper sheets into said front bin area, for upwardly pivoting said support tab means toward said upper limit position thereof to further facilitate the operative reception of said rear stack of cut paper sheets between said base plate member and said support tab means.

14. The paper supply apparatus of claim 12 wherein:

said image reproduction machine has sensing means for detecting the total depletion of a stack of paper being fed thereto and responsively generating an output signal indicative of such depletion, and said shifting means are automatically operable in response to the generation of said output signal.

15. The paper supply apparatus of claim 14 wherein said shifting means include:

a pusher plate member movable forwardly and rearwardly through said rear bin area, and drive means for moving said pusher plate member forwardly through said rear bin area in response to the generation of said output signal.

16. The paper supply apparatus of claim 15 wherein said drive means include:

a reversible electric motor supported on said tray and having an output shaft, and a drive belt drivingly looped around said output shaft and having a side portion anchored to said pusher plate.

17. The paper supply apparatus of claim 16 wherein: said means for downwardly pivoting said base plate member include means interconnected between said drive belt and said base plate member and operative in response to motor-driven rotation of said drive belt, in a manner forwardly moving said pusher plate member, to downwardly pivot said base plate member.

18. The paper supply apparatus of claim 17 wherein said means interconnected between said drive belt and said base plate member include:

a second belt member connected at one end to said base plate member, a first stop block member anchored at the opposite end of said second belt member and positioned adjacent said drive belt, and a second stop block member anchored to said drive belt and positioned to engage and rearwardly move said first stop block member, in a manner rearwardly pulling said second belt member, during forward movement of said pusher plate member by said drive belt.

19. The paper supply apparatus of claim 18 wherein: said drive belt is operative to move said second stop block member forwardly away from said first stop block member, during rearward movement of said pusher plate member, to permit said spring means to upwardly pivot said base plate member.

20. The paper supply apparatus of claim 19 wherein: said pusher plate member is movable by said drive belt between forward and rear limit positions, and said paper supply apparatus further comprises means for automatically reversing said drive motor, to return said pusher plate member to its rear limit position, when said pusher plate member is driven to its forward limit position by said drive motor.

21. The paper supply apparatus of claim 12 wherein: said shifting means are manually operable.

22. The paper supply apparatus of claim 21 wherein said shifting means include:

an auxiliary paper tray positionable within said rear bin area and being configured to receive and operatively support said rear paper stack, said auxiliary paper tray being manually movable forwardly through the interior of said paper feed tray, into said front bin area, to move said rear paper stack into said front bin area subsequent to the total depletion of paper therein, and cooperating means on said paper feed tray and said auxiliary paper tray for causing said auxiliary paper tray to forcibly engage and downwardly pivot said support plate member in response to forward entry of said auxiliary paper tray into said front bin area.

23. The paper supply apparatus of claim 22 wherein said cooperating means include:

forwardly and rearwardly extending slot means formed in opposite portions of said wall means, and guide tab means formed on said auxiliary paper tray and receivable in said slot means for forward and rearward movement therein.

24. The paper supply apparatus of claim 23 wherein: said auxiliary paper tray is forwardly movable through said front bin area to a forward limit position therein, and said slot means and said guide tab means are operative to restrain a rear portion of said auxiliary paper tray, and permit said auxiliary paper tray to be upwardly pivoted about the restrained rear portion thereof by said spring means, in response to said auxiliary paper tray reaching said forward limit position thereof within said front bin area.

25. An image reproduction machine comprising:

a housing having an opening formed therein;

feed means operative to feed paper into said housing, through said opening, from a paper supply stack disposed adjacent said opening;

printing means for imprinting paper fed into said housing by said feed means;

paper sensing means for detecting the total depletion of a stack of paper being fed into said machine by said feed means; and paper supply apparatus for supporting a supply of paper for infeed to said image reproduction machine by said feed means, said paper supply apparatus including:

wall means for defining a paper feed tray having front and rear ends and being forwardly insertable into said housing opening, bin-defining means for defining in said paper feed tray front and rear bin areas respectively configured to receive and support front and rear stacks of cut paper sheets, holding means, associated with said front bin area, for receiving the front paper sheet stack and engaging it in a manner facilitating the sequential infeed of its paper sheets into said machine by said feed means when said paper feed tray is inserted into said housing opening, and shifting means associated with said rear bin area and operable to shift the rear stack of cut paper sheets into said front bin area, and into operative engagement by said holding means, after said feed means have emptied the paper from said front bin area.

26. The image reproduction machine of claim 25 wherein:

each of said front and rear bin areas is configured to operatively receive and support a stack of cut paper sheets having approximately 250 sheets of paper therein.

27. The image reproduction machine of claim 25 wherein:

said paper sensing means are operative to generate an output signal upon sensing the total depletion of paper from said front bin area, and said shifting means are automatically operable in response to the generation of said output signal.

28. The image reproduction machine of claim 25 wherein:

said shifting means are manually operable.

29. The image reproduction machine of claim 25 wherein:

said image reproduction machine is a printer.

30. The image reproduction machine of claim 25 wherein:

said image reproduction machine is a laser printer.

31. The image reproduction machine of claim 25 wherein:

said image reproduction machine is a copier.

* * * * *